United States Patent [19]

Thibault

[11] 4,003,410

[45] Jan. 18, 1977

[54] SHUTTLE SPRING STABILIZER

[75] Inventor: Harrison N. Thibault, Hopedale, Mass.

[73] Assignee: Rockwell International Corporation, Pittsburgh, Pa.

[22] Filed: Mar. 18, 1976

[21] Appl. No.: 667,896

[52] U.S. Cl. ..... 139/207

[51] Int. Cl.[2] ..... D03J 5/16

[58] Field of Search ..... 139/207, 206, 208

[56] References Cited

UNITED STATES PATENTS

| | | | |
|---|---|---|---|
| 1,571,149 | 1/1926 | Stimpson et al. | 139/207 |
| 1,675,132 | 6/1928 | Prescott | 139/207 |
| 1,784,266 | 12/1930 | Bahan | 139/207 |
| 2,154,050 | 4/1939 | Lundgren | 139/207 |
| 3,015,347 | 1/1962 | Kaufmann, Jr. | 139/207 |
| 3,233,635 | 2/1966 | Klocker et al. | 139/207 |
| 3,351,100 | 11/1967 | Bowen et al. | 139/207 |

FOREIGN PATENTS OR APPLICATIONS

| | | | |
|---|---|---|---|
| 400,250 | 11/1942 | Italy | 139/207 |

*Primary Examiner*—James Kee Chi

[57] ABSTRACT

A stabilizer for the spring fixed in a shuttle having opposed laterally flexible spring steel jaws for releasably holding a weft bobbin within the shuttle. The stabilizer is supported by the shuttle spring in operative association with the jaws thereof and serves to control the amount of lateral flexing movement of the latter during removal of a spent bobbin from and the transfer of a new bobbin into a shuttle.

3 Claims, 5 Drawing Figures

SHUTTLE SPRING STABILIZER

BACKGROUND OF THE INVENTION

1. Field of the Invention

The invention pertains to loom shuttles and more particularly to a stabilizing member disposed in operative association with the spring gripping element for releasably holding a weft bobbin within a shuttle. The stabilizing member is effective in locating the opposed gripping surfaces of the gripping element in a position that will provide consistant uniformity of each bobbin transfer and which will be accomplished with less force than has been heretofore required.

2. Description of the Prior Art

Loom shuttles of the type to which the present invention is applicable include an elongated shuttle body with a cavity therein for receiving a weft bobbin. A shuttle spring having opposed jaw members and a U-shaped shank portion is assembled in the shuttle body in a well known manner so as to releasably hold a weft bobbin in the cavity of the shuttle. The type of shuttle spring with which the stabilizer of the present invention is adapted to be operatively associated during the performance of its intended function is shown and described in U.S. Pat. No. 2,729,247.

As is well known to those conversant in the art of fly-shuttle weaving, the opposed jaw members of a shuttle spring must be spaced so as to provide a gripping force on the butt portion of a bobbin which will firmly hold the latter against displacement within the shuttle's cavity as the shuttle is picked back and forth across the width of a loom. To provide an adequate gripping force on the butt portion of a bobbin, the opposed jaw members in their relaxed position have a distance therebetween which is considerably less than the diameter of the bobbin rings which are carried on the butt of the bobbin and which are adapted to be engaged by said jaws to firmly position the bobbin in the shuttle cavity.

The opposed jaw members of a shuttle spring are subjected to what is considered excessive lateral movement or flexing during bobbin transfer which in a known manner is effective in replacing the spent bobbin in the shuttle cavity with one having a full yarn package thereon.

At transfer, the initial movement of a fresh bobbin toward the shuttle causes the butt portion of said bobbin to engage and flex the opposed jaws outwardly beyond their normal bobbin butt gripping position. The spent bobbin is engaged and forced out of the shuttle cavity by the incoming bobbin and during the interim period before the latter bobbin is in position to be held by the opposed jaws, the biasing force of said jaws causes them to flex inwardly beyond their free position and thence immediately outward. High frequency vibrations are set up within the opposed jaws during this interim period and tests have proven that said jaws can move more than once in this manner before the incoming bobbin is in position to be gripped and firmly held by the jaws.

This excessive lateral movement or flexing of the opposed jaw members during bobbin transfer in combination with the amount of force required to move or spread said jaw members a sufficient distance for the reception of a new bobbin has been responsible for a number of serious conditions which require frequent attention as well as what is considered an excessive amount of time to correct such conditions. The impact of the steel bobbin rings striking the spring steel jaws of the shuttle spring has been responsible for wear developing in both the bobbin rings and the steel jaws as well as breakage of said shuttle spring. Additionally, improper bobbin transfer will frequently occur should the gap between a bobbin ring become aligned with the upper edge of one of the jaw members so as to cause a collision between these elements at transfer. Such a collision will seriously damage or break both the bobbin and shuttle spring. Shuttle spring breakage is also attributed to the lateral flexing movement of jaw members during transfer which induces fatigue failure of said jaw members.

U.S. Pat. No. 2,154,050 shows and describes a means for damping the vibrations that develop in the opposed jaws of a shuttle spring. This means comprises a resilient block interposed between and in engagement with the opposed jaw members. Although this device provides a means to cushion or dampen movement of the opposed jaws toward each other, the problems still exist which are associated with flexing relative to fatigue failure of the jaws as well as the amount of initial force required to transfer a full bobbin into the shuttle cavity.

The shuttle spring stabilizer according to the present invention provides a very definite advance in the art by substantially reducing the above-described problems associated with bobbin replenishment in fly-shuttle looms. The stabilizer is carried within the shuttle spring and is effective in limiting the inward movement of the opposed jaw members after the removal of a spent bobbin that was held therebetween. Additionally, the jaw members are maintained in an outwardly flexed predetermined position by the stabilizer which reduces the distance the jaw members have to be opened or spread to receive a fresh bobbin.

As is well known to those conversant in the art, the opposed jaws of shuttle springs are provided with grooves which are adapted to receive and grip the rings of a bobbin. The upper surfaces of the jaws adjacent these grooves are tapered downwardly a distance to communicate with said grooves and provide camming surfaces that are engaged by a bobbins's rings during transfer to effect the spreading of said jaws a distance sufficient for the bobbin rings to enter the grooves. By maintaining the jaw members in an outwardly flexed predetermined position less camming force is required to transfer a fresh bobbin into the shuttle cavity and prevents inward flexing of the jaw members during transfers thus promoting longer spring life by eliminating the high frequency vibrations referred to above.

With the jaws always being in the same location to receive a fresh bobbin will provide a more uniform and consistant transfer condition for each new bobbin than has heretofore been possible and the greater space between the opposed jaws will reduce substantially shuttle spring abuse caused by the bobbin rings at transfer and will minimize the possibility of the gap in a bobbin ring becoming engaged with the upper edge of a jaw member.

SUMMARY OF THE INVENTION

The shuttle spring stabilizer according to the invention comprises a member fabricated from a non-flexible or compression resistant plastic material and is formed to a configuration that is substantially T-shaped. One end of the stabilizer has a lateral dimension of a width whereby it is adapted to be ridgedly held by the U-shaped shank portion of a shuttle spring. The opposite end of the stabilizer has a lateral dimension of substantially greater width and the two ends are interconnected by diverging sides which give the stabilizer its generally T-shape configuration. In assembled position within a shuttle spring that end of the stabilizer of greater width is located so that the sides thereof engage the inner sides of the opposed jaws of said shuttle spring during transfer of a weft bobbin. The width of this end of the stabilizer is such as to hold the opposed jaws in an outwardly flexed pedetermined location which lessens the distance required to spread the jaws for the reception of a fresh bobbin therebetween. Additionally, by locating the jaws in this manner prevents said jaws from flexing inwardly to and beyond their relaxed or free position during the period of removal of a spent bobbin and the replenishment of a new bobbin into the shuttle cavity.

It is a general object of the invention to provide a stabilizer for a shuttle spring which will increase the life expectency of the latter by substantially reducing the amount lateral flexing movement to which the gripping jaws thereof are normally subjected during bobbin replenishment.

A further object is to provide a stabilizer for a shuttle spring which will decrease the amount of force normally required to transfer a bobbin into a shuttle and provide a consistent and more uniform bobbin transfer condition than has been heretofore possible.

These and other objects of the invention will become more fully apparent by reference to the appended claims and as the following detailed description proceeds in reference to the figures of drawing wherein:

DESCRIPTION OF THE PREFERRED EMBODIMENT

As the general construction and operation of a loom shuttle to which the present invention is applicable is well known and familiar to those conversant in the art, and as the invention is entirely concerned with a device for stabilizing the spring which is adapted to position a weft bobbin within a shuttle, it is only considered necessary here to illustrate and describe those parts which are directly concerned with a perferred form of the invention.

Figure 1:
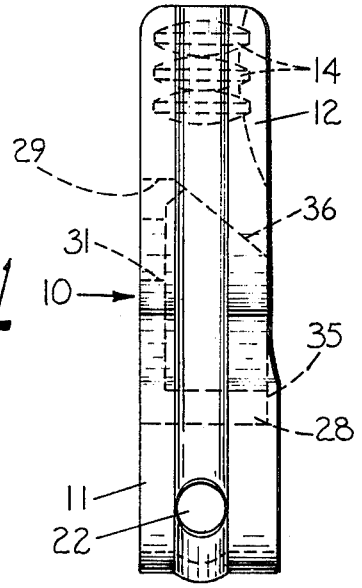
FIG. 1 is a view in side elevation of a shuttle spring showing by means of dotted lines the shuttle spring stabilizer according to the invention assembled therein.
Figure 2:
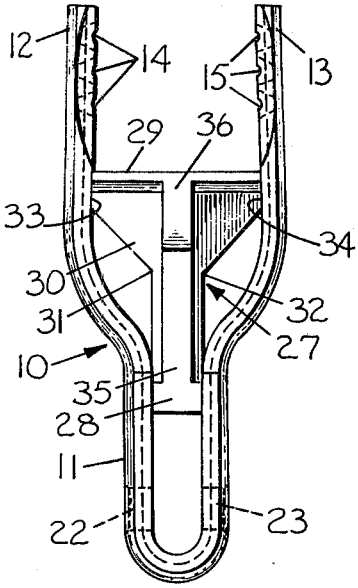
FIG. 2 is a top view of the shuttle spring and stabilizer shown in FIG. 1.
Figure 4:
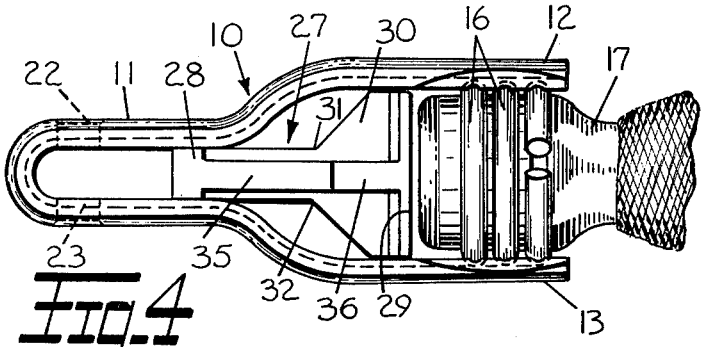
FIG. 4 is a view similar to FIG. 2 but showing the manner in which a weft bobbin is gripped by the opposed jaws of a shuttle spring.

In FIGS. 1, 2 and 4 a shuttle spring of conventional configuration is indicated generally by numeral 10. This spring includes a U-shaped shank 11 and extending therefrom opposed bobbin holding or gripping jaws 12 and 13. These jaws 12 and 13 are provided with the usual grooves 14 and 15 respectively for receiving the rings 16 carried on the butt portion of a weft bobbin 17 (FIG. 4).

Figure 5:
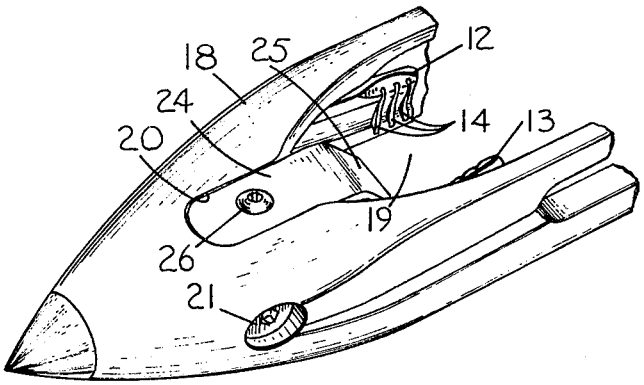
FIG. 5 is a perspective view of that end of a loom shuttle within which the shuttle spring assembles.

With reference to FIG. 5 a portion of a loom shuttle is identified by numeral 18 having a cavity 19 within which the weft bobbin 17 is gripped during the performance of its intended function. Communicating with the cavity 19 the shuttle includes a recess 20 within which the shank 11 assembles by means of a cap screw 21. The shank portion of cap screw 21 passes through aligned apertures 22 and 23 provided in said shank. The shuttle spring 10 includes the usual form of cover 24 (FIG. 5) having an inclined surface 25 that serves as a guide for the bobbin as it is forcibly inserted between the gripping jaws 12 and 13 and into the cavity 19. This cover 24 is of conventional configuration having spaced upper and lower surfaces which are interconnected by the inclined surface 25 and in assembled position the U-shaped shank 11 of the shuttle spring is located between said upper and lower surfaces. As shown in FIG. 5 a bolt 26 serves to fix the cover 24 in the usual manner in the shuttle 18.

Figure 3:
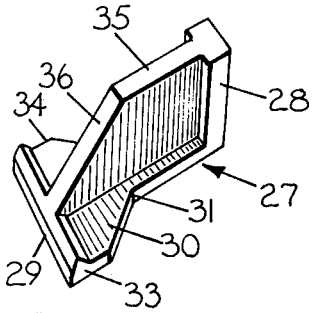
FIG. 3 is a perspective view of the shuttle spring stabilizer.

The shuttle spring stabilizer according to the invention is identified generally in FIGS. 2, 3 and 4 by numeral 27 and as seen looking from the top thereof it has a configuration that is generally T-shaped.

FIG. 3 shows the shuttle spring stabilizer 27 in perspective with one end thereof defining a vertically extending rib 28 having a lateral dimension of a width which in assembled position is clampingly held by the U-shaped shank 11 (FIGS. 2 and 4). The opposite end of the stabilizer 27 is depicted by numeral 29 and has a lateral dimension of a width which causes the sides of this end to engage opposed surfaces of the gripping jaws 12 and 13 so as to maintain the latter in an outwardly flexed predetermined location during the absence of a weft bobbin therebetween. When a bobbin 17 is being held by the gripping jaws 12 and 13 (FIG. 4) a small amount of clearance exists between the sides of end 29 and the gripping jaws 12 and 13 thus providing a full gripping force by said jaws on the rings 16 of said bobbin. Ends 28 and 29 of the stabilizer 27 are interconnected by a lower planar surface 30 which for a portion of its length has the same lateral dimension as rib 28. At a point intermediate the ends 28 and 29, the sides of the planar surface diverge outwardly, as at 31 and 32 (FIGS. 2 and 4), and converge with stop surfaces 33 and 34 respectively which form the sides of end 29 that are adapted to engage opposed surfaces of the gripping jaws 12 and 13 as shown in FIG. 2.

An upwardly extending and centrally disposed reinforcing web 35 is integrally formed with and interconnects ends 28, 29 and the planar surface 30. That end of the web 30 which joins end 29 of the stabilizer 27 is tapered as at 36 and provides the necessary clearance for the inclined surface 25 of the cover 24 which in assembled position overlies this portion of the stabilizer.

To summarize the operation, end 28 of the stabilizer is clampingly held by the opposed surfaces of the U-shaped shank 11 of the shuttle spring. In addition to serving as a means of support for the stabilizer its end 28 serves to replace the conventional filler block normally carried within the U-shaped shank to resist the clamping forces of the cap screw 21 for fixing the shuttle spring in the shuttle. The surfaces 33 and 34 which form the sides of end 29 of the stabilizer are disposed so as to engage opposed surfaces of the gripping jaws 13 and 14 and serve to maintain the latter in an outwardly flexed predetermined position during the absence of a weft bobbin therebetween. By holding the gripping jaws outwardly from their relaxed or unflexed position less camming force is required to spread said jaws a sufficient distance during transfer to receive a fresh bobbin.

During the interim period, which is that period during the driving out of the spent bobbin and before a fresh bobbin is in clamping position between the jaws, the stabilizer is effective in preventing the jaws from flexing inwardly beyond the sides of end 29 of the stabilizer. By preventing such flexing of the gripping jaws, the high frequency vibrations set up during transfer with shuttle spring arrangements of the prior art have been eliminated, and in so doing has greatly decreased the possibility of fatigue failure of the shuttle spring and substantially increased the life expectancy thereof.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. A stabilizer for a shuttle spring of the type having a U-shaped shank portion with opposed laterally flexible spring steel gripping jaws for releasably holding a weft bobbin therebetween, said stabilizer comprising:

a. a body portion;

b. a rib member (28) forming one end of said body portion having a lateral dimension of a width to be rigidly held by the shank portion;

c. means interconnected with and spaced from said rib member defining the opposite end (29) of said body portion having a lateral dimension of greater width than said rib member; and d. stop surfaces (33–34) defining the sides of said opposite end of said body portion for engaging the gripping jaws at locations intermediate their ends and the shank portion during bobbin replenishment to prevent inward flexing thereof beyond a predetermined position.

2. The stabilizer according to claim 1 wherein said body portion includes a planar surface (30) with side surfaces diverging outwardly intermediate said ends to converge with and form said stop surfaces (33–34).

3. The stabilizer according to claim 2 wherein said body portion is fabricated from a compression resistant plastic material.

* * * * *